US009987537B1

(12) United States Patent
Allen

(10) Patent No.: US 9,987,537 B1
(45) Date of Patent: Jun. 5, 2018

(54) SOFT TOSS GAME APPARATUS AND METHOD OF PLAYING GAME

(71) Applicant: Christopher Allen, Charlotte, NC (US)

(72) Inventor: Christopher Allen, Charlotte, NC (US)

( * ) Notice: Subject to any disclaimer, the term of this patent is extended or adjusted under 35 U.S.C. 154(b) by 0 days. days.

(21) Appl. No.: 14/179,516

(22) Filed: Feb. 12, 2014

Related U.S. Application Data

(60) Provisional application No. 61/763,525, filed on Feb. 12, 2013.

(51) Int. Cl.
*A63B 63/00* (2006.01)
*A63B 67/06* (2006.01)

(52) U.S. Cl.
CPC ..... *A63B 67/06* (2013.01)

(58) Field of Classification Search
CPC ..... A63B 63/08; A63B 67/06
USPC ..... 273/348, 336–339, 352–353, 398–400; D21/303; 206/514, 505; 220/23.89; 446/69
See application file for complete search history.

(56) References Cited

U.S. PATENT DOCUMENTS 1,928,799 A * 10/1933 Stevens ..... A01G 9/023 239/17
2,183,107 A * 12/1939 Savage ..... 273/400
2,988,361 A * 6/1961 Dart ..... A63F 7/3622 273/120 R
4,392,653 A 7/1983 Blume, Sr.
5,052,693 A * 10/1991 Hicks ..... 273/336
7,134,662 B2 * 11/2006 Menendez ..... 273/400
8,550,014 B1 * 10/2013 Mariani ..... 108/150
2004/0003760 A1 * 1/2004 O'Connell Cooper et al. ..... 108/26
2010/0320692 A1 12/2010 Tookey
2012/0169012 A1 * 7/2012 Parker et al. ..... 273/400
2014/0015198 A1 1/2014 Francis

OTHER PUBLICATIONS

The Chickabug Blog, Golf Party, http://blog.chickabug.com/2012/08/golf-first-birthday-party.html, Aug. 6, 2012.*

* cited by examiner

*Primary Examiner* — Melba Bumgarner
*Assistant Examiner* — Laura L Davison
(74) *Attorney, Agent, or Firm* — Tilman Wright, PLLC; James D. Wright; David R. Higgins

(57) ABSTRACT

A soft toss game apparatus includes a plurality of tossable objects and a collapsible target structure which includes a plurality of bucket components. Each bucket component includes an outer wall, a bottom surface, and an open area at the top of the outer wall that is large enough to receive tossable objects tossed by a user. The open area at the top of each respective bucket component varies in size, with the difference being at least large enough to accommodate the size of the tossable objects. In a first state, the bucket components are assembled in a stack such that, for each lower bucket component having an upper bucket component directly above it, the lower bucket component extends laterally beyond the upper bucket component. In a second state, the bucket components are dissembled from the stack and repositioned to be nested within one another.

16 Claims, 12 Drawing Sheets

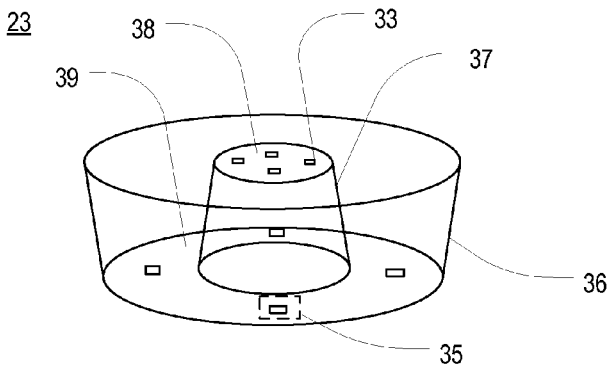
FIG. 8B
FIG. 8C
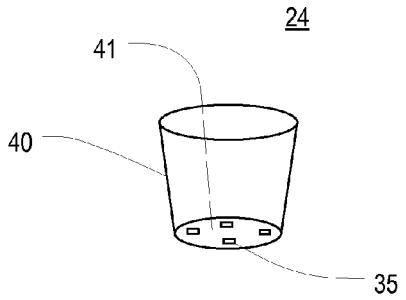
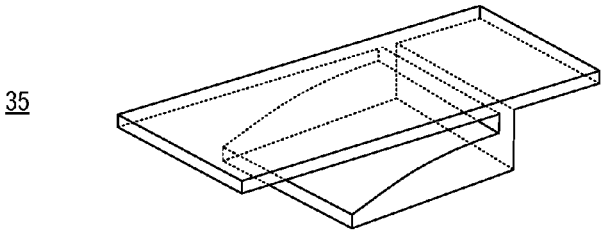
FIG. 8E

SOFT TOSS GAME APPARATUS AND METHOD OF PLAYING GAME

CROSS-REFERENCE TO RELATED APPLICATION

The present application is a U.S. non-provisional patent application of, and claims priority under 35 U.S.C. § 119(e) to, U.S. provisional patent application Ser. No. 61/763,525, filed Feb. 12, 2013 and entitled "SOFT TOSS GAME APPARATUS AND METHOD OF PLAYING GAME," the entirety of which is expressly incorporated by reference herein.

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND OF THE PRESENT INVENTION

Field of the Present Invention

The present invention relates generally to games, and, in particular, to games involving small objects such as beanbags being tossed at a tiered and collapsible target structure.

Background

Various games are known that involve tossing small objects such as beanbags, washers, balls and other projectiles at a target. The physical effort required in many of these games is relatively low, thereby promoting friendly competition in a low-stress environment. Such games, including the popular "corn hole" game, are popular at outdoor gatherings such as parties, "tailgating," and the like. However, new games are always desired to maintain interest from party-goers.

One game that involves tossing projectiles into a plurality of target buckets is disclosed in U.S. Pat. No. 5,052,693 to Hicks. However, the target apparatus is unwieldy and cannot be dissembled or otherwise adjusted in any way. Because of this, the target apparatus of Hicks cannot be moved or stored easily. Thus, the target apparatus, while presumably suitable for its intended purpose, still suffers from significant drawbacks. Other game apparatuses suffer from similar problems. As a result, a need exists for a new game apparatus and methods of playing games using same.

SUMMARY OF THE PRESENT INVENTION

The present invention comprises a game involving tossing small objects at a target.

Broadly defined, the present invention according to one aspect is a soft toss game apparatus as shown and described.

Broadly defined, the present invention according to another aspect is a soft toss game apparatus, comprising a plurality of tiered buckets.

Broadly defined, the present invention according to another aspect is a soft toss game apparatus, comprising a plurality of telescoping buckets.

Broadly defined, the present invention according to another aspect is a soft toss game apparatus, comprising a collapsible target structure as shown and described.

Broadly defined, the present invention according to another aspect is a soft toss game apparatus, including: a collapsible target structure; and a plurality of tossable objects.

In a feature of this aspect, the collapsible target structure includes a plurality of buckets. In other features, the buckets are concentric; or the tops of the buckets are disposed at tiered heights.

Broadly defined, the present invention according to another aspect is a game utilizing a soft toss game apparatus, as shown and described.

Broadly defined, the present invention according to another aspect is a method of playing a game utilizing a soft toss game apparatus as shown and described.

Broadly defined, the present invention according to another aspect is a soft toss game apparatus, comprising a plurality of bucket compartments stacked on top of one another and structurally attached together for gameplay.

Broadly defined, the present invention according to another aspect is a soft toss game apparatus, including: a plurality of tossable objects; and a collapsible target structure, the target structure including a plurality of bucket components, wherein: each bucket component includes an outer wall, a bottom surface, and an open area at the top of the outer wall that is large enough to receive any of the plurality of tossable objects when tossed by a user; the open area at the top of each bucket component is different in size from that of the other bucket components, with the difference being at least large enough to accommodate the size of the tossable objects; in a first state, the bucket components are assembled in a stack such that, for each lower bucket component having an upper bucket component directly above it, the lower bucket component extends laterally beyond the upper bucket component such that sufficient open area is provided between an outer periphery of the top of the lower bucket and an outer periphery of the bottom surface of the upper bucket component; and in a second state, the bucket components are dissembled from the stack and repositioned such that the bucket components are nested within one another.

In a feature of this aspect, the outer wall of each bucket component is flared outward such that an area defined by the top of the outer wall is larger than an area defined by the bottom of the outer wall. In a further feature, each lower bucket includes an inner wall that is spaced apart from the outer wall, and wherein the inner wall is flared inward away from the outer wall.

In another feature of this aspect, each lower bucket further includes an inner wall that is spaced apart from the outer wall, and wherein the open area at the top of the bucket is defined as the open area between the outer wall and the inner wall. In further features, the bottom surface of each lower bucket component includes a first portion between the outer wall and the inner wall and wherein the inner wall surrounds a second portion of the bottom surface; the inner wall of each lower bucket component includes a top, and wherein each lower bucket component further includes a top surface extending between and within the top of the inner wall; the top surface of each lower bucket component includes a first interlocking structure, wherein the bottom surface of each upper bucket component includes a second interlocking structure, and wherein, in the stacked state, each respective first interlocking structure couples with a corresponding second interlocking structure to maintain the target structure in such stacked state; each of either the first interlocking structures or the second interlocking structures includes a finger lock, and wherein the other of the first interlocking structures or the second interlocking structures includes a slot within which the finger lock is inserted; the inner wall of each lower bucket component includes a top where a first channel structure is disposed, wherein the outer wall of each upper bucket component includes a bottom where a second channel structure is disposed, and wherein, in the stacked state, the first channel structure of each lower bucket component is interlocked with the second channel structure of the upper bucket directly above it to maintain such upper bucket component in place on top of the lower bucket component; the first channel structure extends around only a portion of the top of the lower bucket component and the second channel structure extends around only a portion of the bottom of the upper bucket component such that the upper bucket component directly above each lower bucket component may be manipulated relative to such lower bucket component to interlock the first channel structure with the second channel structure; the top of the lower bucket component is circular, the bottom of the upper bucket component is circular, and wherein the upper bucket component directly above each lower bucket component may be rotated relative to such lower bucket component to interlock the first channel structure with the second channel structure; the first and second channel structures extend laterally away from their respective walls; the inner wall of each lower bucket component includes a bottom where a third channel structure is disposed, and wherein, in the unstacked state, at least one upper bucket component is arranged such that the second channel structure of such upper bucket component is interlocked with the third channel structure of the lower bucket component directly beneath when the at least one upper bucket is nested within the lower bucket component; in the unstacked state, the uppermost bucket component is inverted and nested within the lower bucket component directly below such upper bucket component to create an enclosed compartment, and wherein the plurality of tossable objects are stored in the enclosed compartment; and/or the first channel structure of the inverted bucket component is interlocked with the third channel structure of the lower bucket component directly below the inverted bucket component when the inverted bucket component is nested within such lower bucket component.

In another feature of this aspect, each bucket component is circular.

In another feature of this aspect, in the stacked state, the bucket components are arranged concentrically in the stack.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Further features, embodiments, and advantages of the present invention will become apparent from the following detailed description with reference to the drawings, wherein:

FIG. 8B is a perspective view of one of the three components of the collapsible target structure of FIG. 7;

FIG. 8C is a perspective view of one of the three components of the collapsible target structure of FIG. 7;

FIG. 8E is an enlarged isometric detail of a finger lock;

DETAILED DESCRIPTION

Figure 1:
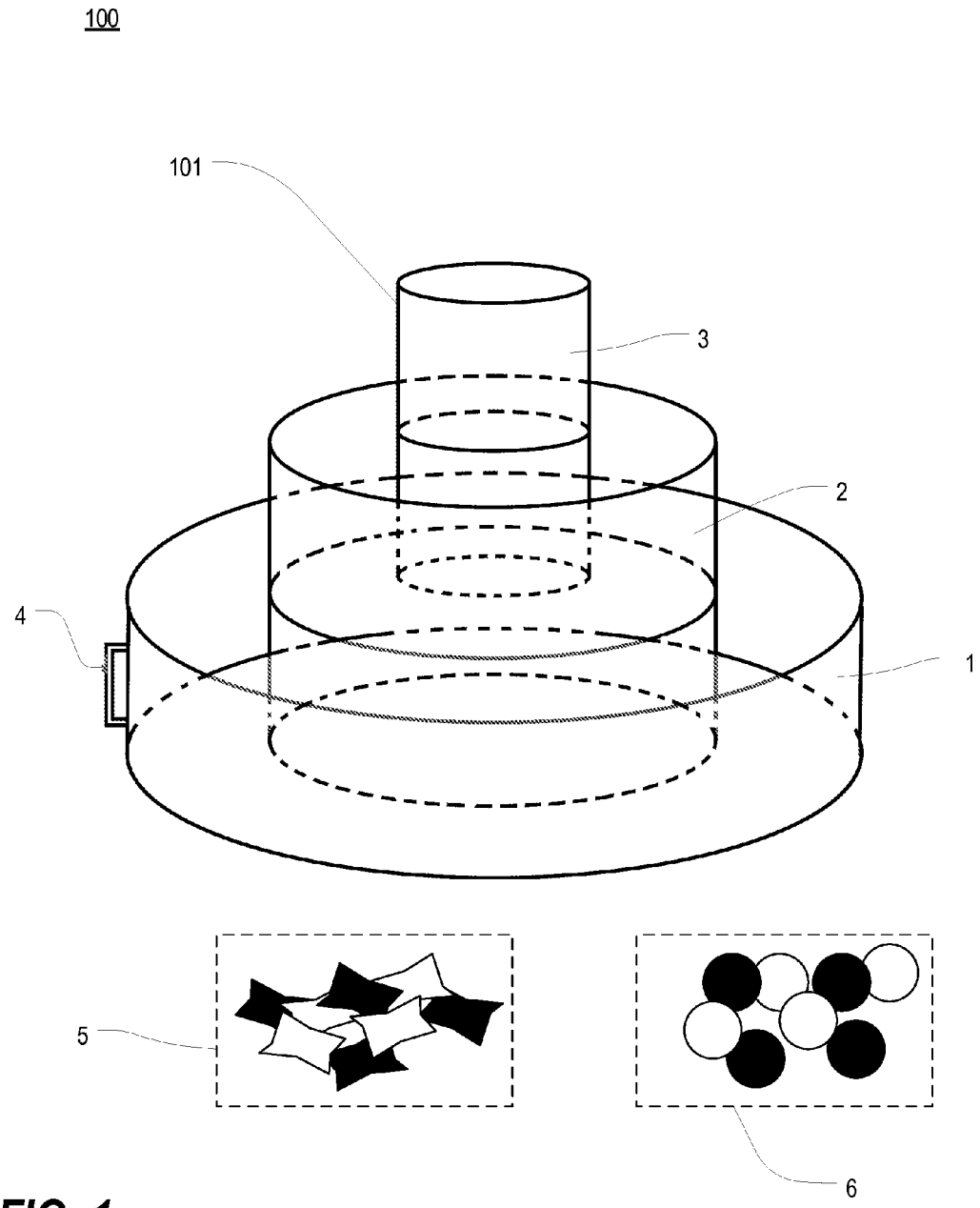
FIG. 1 is a perspective view of a soft toss game apparatus in accordance with one or more preferred embodiments of the present invention.

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. As should be understood, any embodiment may incorporate only one or a plurality of the above-disclosed aspects of the invention and may further incorporate only one or a plurality of the above-disclosed features. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Regarding applicability of 35 U.S.C. § 112, ¶6, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers," "a picnic basket having crackers without cheese," and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, in which like numerals represent like components throughout the several views, one or more preferred embodiments of the present invention are next described. The following description of one or more preferred embodiment(s) is merely exemplary in nature and is in no way intended to limit the invention, its application, or uses.

FIG. 1 is a perspective view of a soft toss game apparatus in accordance with one or more preferred embodiments of the present invention. The soft toss game apparatus 100 includes a collapsible target structure 101 and a plurality of beanbags 5, hacky sacks 6, balls or other small objects to be used for tossing at the target structure 101. In at least some embodiments, eight objects of similar size, shape, and design are used, with four of the objects being of one color or decorative appearance and the other four objects being of a different color or decorative appearance. The target structure 101 includes a plurality of collapsible bucket components 1,2,3 and a handle 4 to assist with transportation of the apparatus 100 in a collapsed state. In the illustrated embodiment, there are three buckets 1,2,3, and the handle 4 is attached to the widest bucket component 1. However, it will be appreciated that greater or fewer numbers of bucket components may be used, and that the handle 4 may be located elsewhere or supplemented by one or more additional handles 4.

Figure 2:
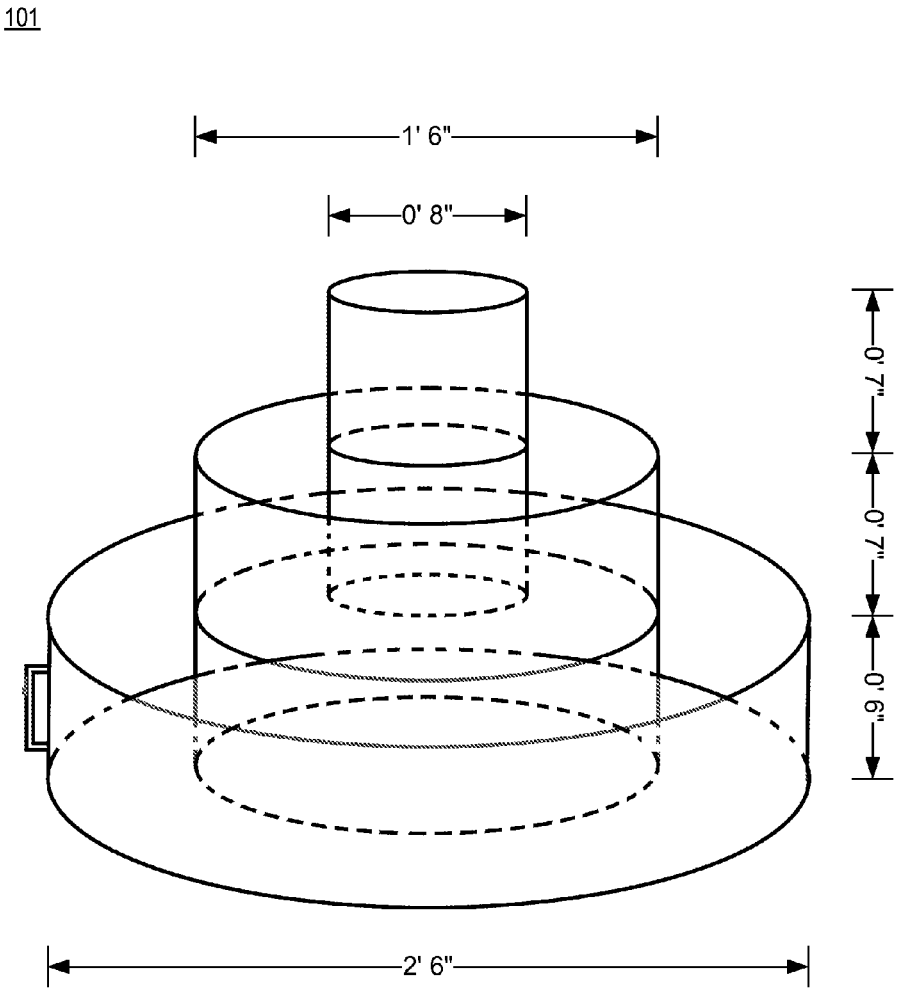
FIG. 2 is a perspective view of the collapsible target structure of FIG. 1, illustrating general dimensions suitable for use in implementing the structure.

FIG. 2 is a perspective view of the collapsible target structure 101 of FIG. 1, illustrating general dimensions suitable for use in implementing the structure. In particular, the top bucket component 3 is 8" wide and 7" tall, the middle bucket 2 is 1'6" wide and 7" tall, and the bottom bucket 1 is 2'6" wide and 6" tall. However, other dimensions may alternatively be used, e.g., buckets 1,2,3 that are 26", 18", and 6" in diameter and 5" or 6" in height. As mentioned previously, one or more handles 4 or hand holes may be provided to facilitate carrying, repositioning, or the like. In some embodiments, such handles 4 may extend outward from the periphery of the widest bucket 1, as shown. In other embodiments, such handles 4 may be built-in, may include recesses or holes that may be gripped, or the like. The location of such handles is preferably related to the structural rigidity of the structure 101, how much deflection will be caused when the structure 101 is being held with the beanbags 5 or other objects inside, and the like.

Figure 3A:
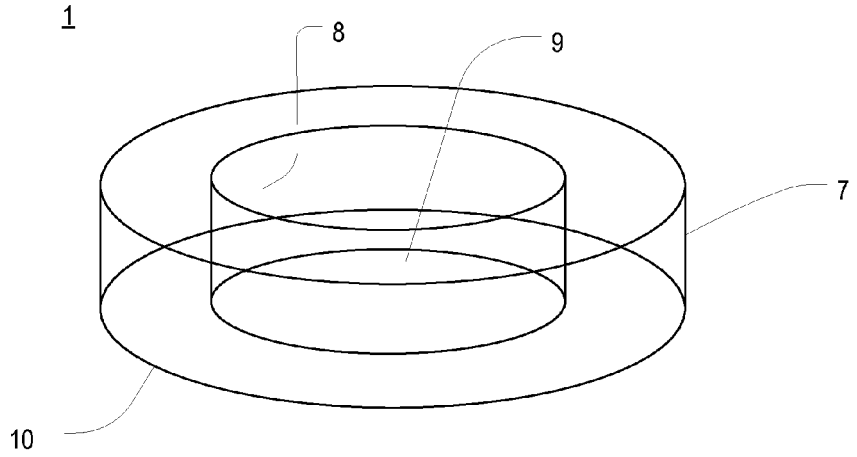
FIG. 3A is a perspective view of one of the three components of the collapsible target structure of FIG. 2.
Figure 3B:
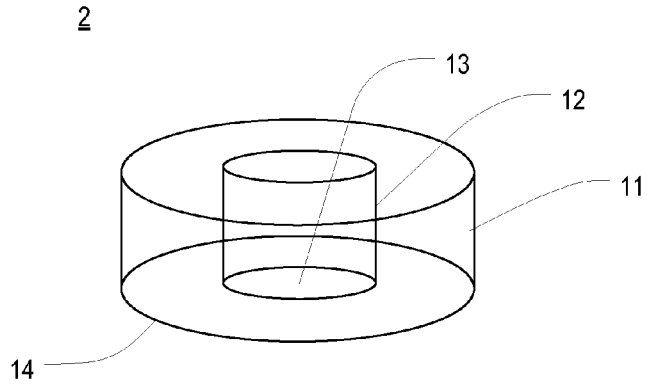
FIG. 3B is a perspective view of one of the three components of the collapsible target structure of FIG. 2.
Figure 3C:
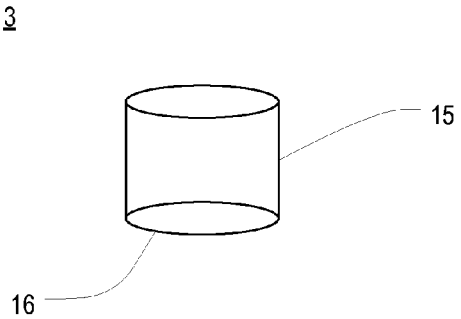
FIG. 3C is a perspective view of one of the three components of the collapsible target structure of FIG. 2.

FIGS. 3A-3C are perspective views of the three components 1,2,3 of the collapsible target structure 101 of FIG. 2. The target structure 101 includes three open buckets 1,2,3 of different widths or diameters. FIG. 3A is a perspective view of the widest, bottommost bucket 1, which includes an inner circular floor 9, an outer donut shaped projectile compartment floor 10, a cylindrical outer wall 7 extending upward from the outer periphery (circumference) of the projectile compartment floor 10, and a cylindrical inner wall 8 extending upward from the outer periphery (circumference) of the inner circular floor 9. FIG. 3B is a perspective view of the middle bucket 2, which likewise includes an inner circular floor 13, an outer donut shaped projectile compartment floor 14, a cylindrical outer wall 11 extending upward from the periphery (circumference) of the projectile compartment floor 14, and a cylindrical inner wall 12 extending upward from the outer periphery (circumference) of the inner circular floor 13. FIG. 3C is a perspective view of the smallest, topmost bucket 3, which includes a circular floor 16 and a cylindrical outer wall 15 extending upward from the periphery (circumference) of the circular floor 16. In at least some embodiments, the various buckets 1,2,3 and their cylindrical walls (inner and outer) are concentric with each other. In at least some embodiments, the buckets 1,2,3 are made of plastic, but in other embodiments the buckets are made of metal, a combination of plastic and metal, or the like.

In some embodiments, the buckets 1,2,3 do not have circular floors (i.e., are not cylindrical), but instead have square, rectangular, diamond-shaped, or oval-shaped floors and correspondingly-shaped walls.

Figure 4:
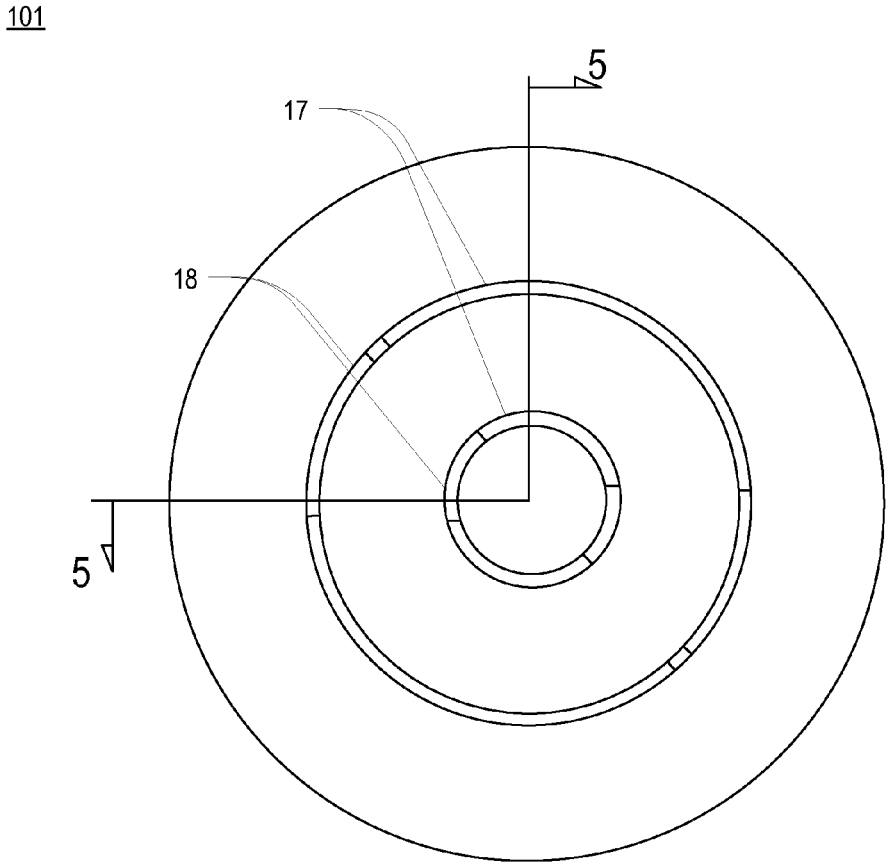
FIG. 4 is a top view of the collapsible target structure of FIG. 2.
Figure 5:
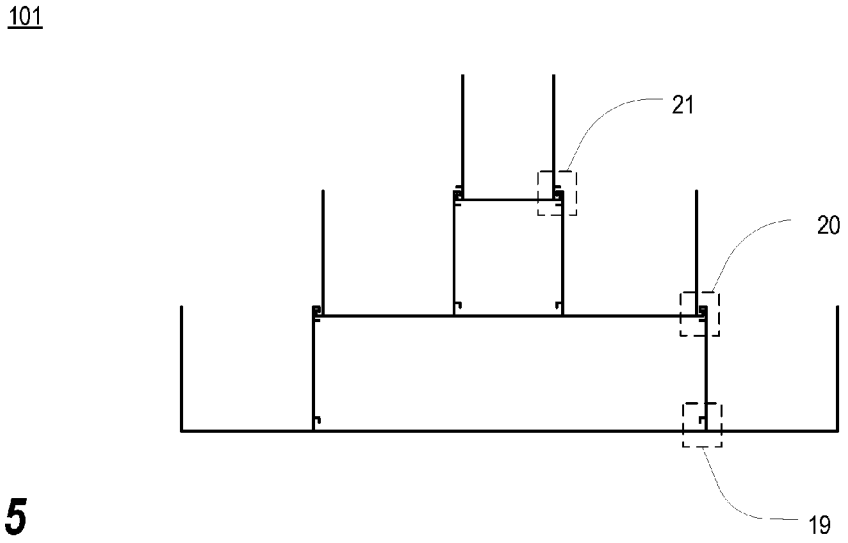
FIG. 5 is a side cross-sectional view of the collapsible target structure of FIG. 4, taken along line 5-5.

FIG. 4 is a top view of the collapsible target structure 101 of FIG. 2, and FIG. 5 is a side cross-sectional view of the collapsible target structure 101 of FIG. 4, taken along line 5-5. As shown collectively therein, channel structures 17 are provided around portions of the top and bottom (inward-facing side) 21,19 of the inner walls 8 of the largest bucket 1, the top and bottom (inward-facing side) of the inner wall 12 of the middle bucket 2, the bottom (outward-facing side) of the middle bucket 20, and the bottom (outward-facing side) of the smallest bucket 21. As perhaps best shown in FIG. 4, channel structures 17 are located around some portions of the various walls 8,12,15, other areas 18 do not include such structures 17. In particular, at least some embodiments have channel structures 17 around less than half of each respective circumference. Thus, a particular bucket 1,2,3 may be separated from another bucket by rotating (twisting) one bucket relative to the other until the channel structures 17 are disengaged, and the smaller bucket may then be lifted from the larger bucket. Conversely, two buckets may be assembled by rotating the channel structures 17 into a separated (disengaged) state and then rotating (twisting) one bucket relative to the other while the respective channel structures 17 engage each other. When the channel structures 17 are fully engaged, the two buckets will remain coupled together.

Figure 6:
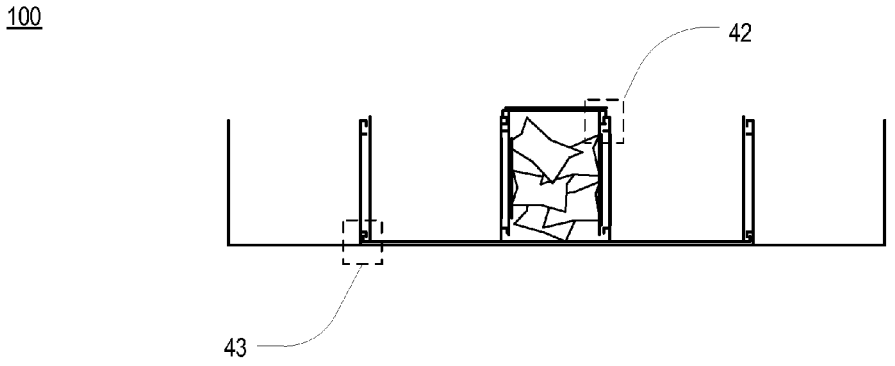
FIG. 6 is a side cross-sectional view of the collapsible target structure of FIG. 5, shown in a collapsed travel state.

FIG. 6 is a side cross-sectional view of the collapsible target structure 101 of FIG. 5, shown in a collapsed travel state. As shown therein, the middle bucket 2 may be lowered to the bottom of the largest bucket 1 and twisted into place such that the channel structures 17 at the bottom of the middle bucket 2 are interlocked with mating channel structures 17 at the bottom of the cylindrical inner wall on the inward-facing side to form an interlocked channel structure 43. The beanbags 5 or other objects may be stored on the floor 13 in the central space inside. The smallest bucket 3 may then be inverted and inserted into the central space of the middle bucket 2, covering and retaining the beanbags 5 or other objects inside. The channel structures 17 at the bottom of the smallest bucket 3 as it appears in FIG. 5 (and is inverted in FIG. 6) are positioned so that they can be rotated into engagement with the channel structures 17 at the top of the cylindrical inner wall 12 to form another interlocked channel structure 42. As shown in FIG. 6, the smallest bucket 3 is thus retained in the central space (inside the inner wall 12) of the middle bucket 2, and the beanbags 5 or other objects are contained inside.

Figure 7:
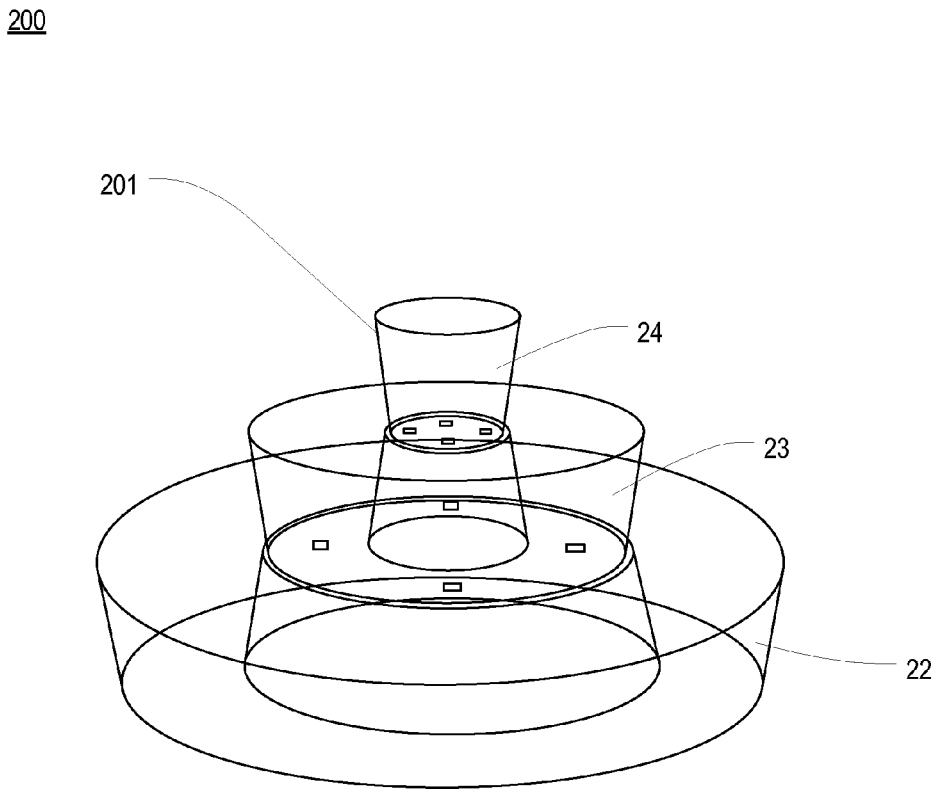
FIG. 7 is a perspective view of a soft toss game apparatus in accordance with another one of the preferred embodiments of the present invention.

FIG. 7 is a perspective view of a soft toss game apparatus 200 in accordance another one of the preferred embodiments of the present invention. As shown therein, the soft toss game apparatus 200 has many similarities to the system of FIGS. 1-6, including a collapsible target structure 201 with a plurality of bucket components 22,23,24.

Figure 8A:
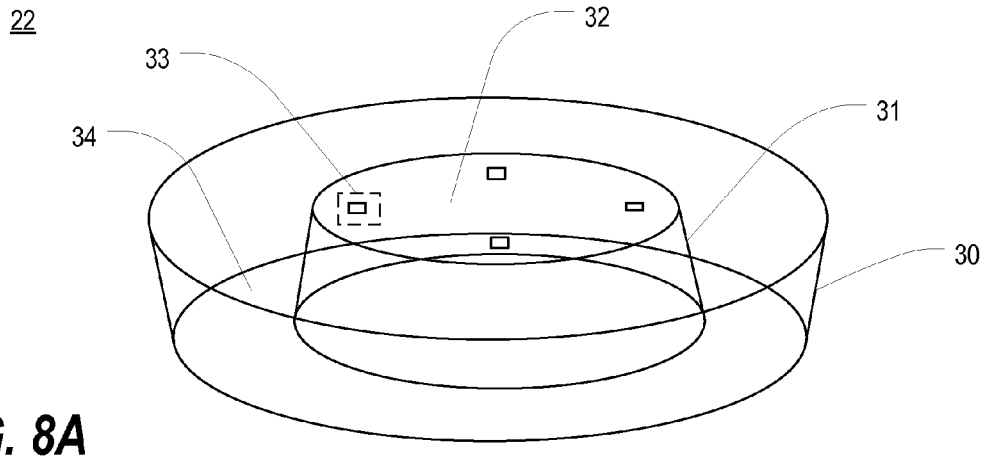
FIG. 8A is a perspective view of one of the three components of the collapsible target structure of FIG. 7.
Figure 8D:
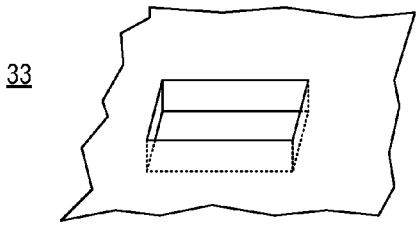
FIG. 8D is an enlarged isometric details of a box slot.

FIGS. 8A-8C are perspective views of the three components 22,23,24 of the collapsible target structure 201 of FIG. 7. The target structure includes three open buckets 22,23,24 of different widths or diameters. FIG. 8A is a perspective view of the largest, bottommost bucket 22, which includes an outer donut shaped projectile compartment floor 34, a circular platform 32 for bucket 23 to rest on, a plurality of box slot openings 33 spaced evenly around the periphery of the circular platform 32, a cylindrical outer wall 30 extending upward and flared outward from the periphery (circumference) of the bucket floor 34, and a cylindrical inner wall 31 extending upward and flared inward from the interior perimeter of the bucket floor 34. In at least one some embodiments, four box slot openings 33 are spaced evenly on the circular platform 32 between the periphery and the center of the platform 32. FIG. 8B is a perspective view of the middle bucket, which likewise includes an outer donut shaped projectile compartment floor 39, a circular platform 38 for bucket 24 to rest on, a plurality of box slot openings 33 spaced evenly around the circular platform 38, a plurality of finger lock projections 35 corresponding to the number of box slot openings 33 on the circular platform 32 spaced evenly around the bucket floor 39, a cylindrical outer wall 36 extending upward, and flared outward from the periphery (circumference) of the bucket floor 39, and a cylindrical inner wall 37 extending upward and inward from the interior perimeter of the bucket floor 39. FIG. 8C is a perspective view of the smallest, topmost bucket 24, which includes a circular floor 41, a plurality of finger lock projections 35 corresponding to the number of box slot openings 33 on the circular platform 38 spaced evenly around the circular floor 41, and a cylindrical outer wall 40 extending upward and flared outward from the periphery (circumference) of the bucket floor 41. FIGS. 8D and 8E are enlarged isometric details of a box slot 33 and finger lock 35 respectively.

Figure 9A:
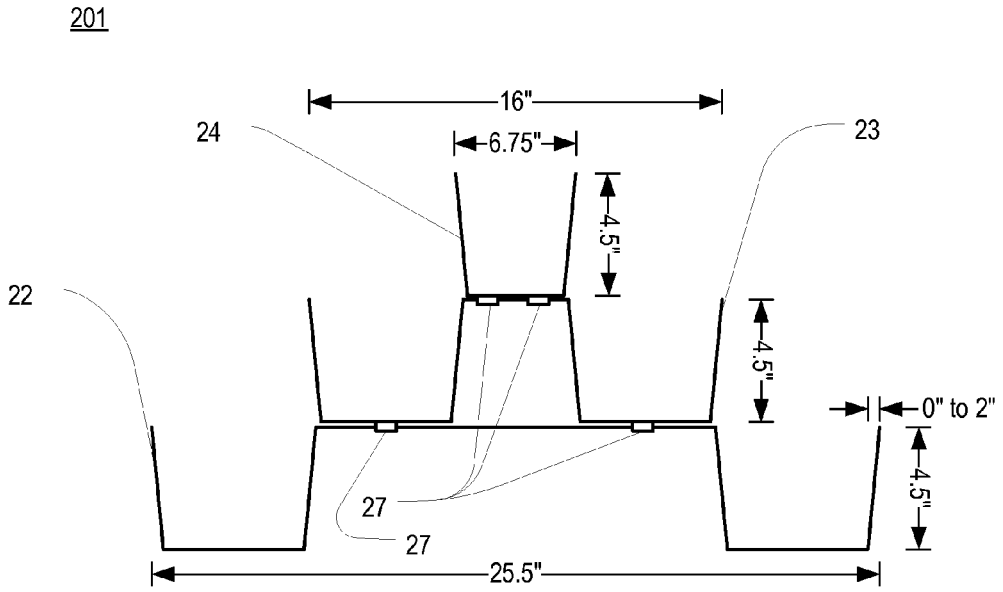
FIG. 9A is a side cross-sectional view of the collapsible target structure of FIG. 7, shown in the game play state.
Figure 9B:
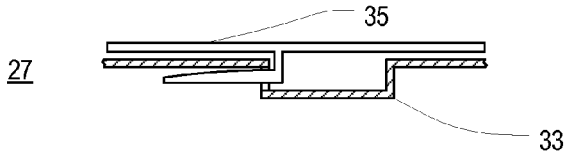
FIG. 9B is a cut section detail of the finger lock and box slot connection for secure structure during game play.

FIG. 9A is a side cross-sectional view of the collapsible target structure 201 of FIG. 7 illustrating general dimensions suitable for use in implementing the structure. As shown therein, the middle bucket 23 rests on platform 32 so that finger locks 35 are of appropriate size to rest inside box slots 33, and be rotated or twisted so that finger locks 35 frictionally grab the platform 32 as to lock buckets into place. FIG. 9B a cut section detail of a finger lock 35 locked inside the box slot 33. Similarly, bucket 24 rests on platform 38 and is twisted into locked position 27. When all three components 22,23,24 are locked together gameplay can begin.

Figure 10A:
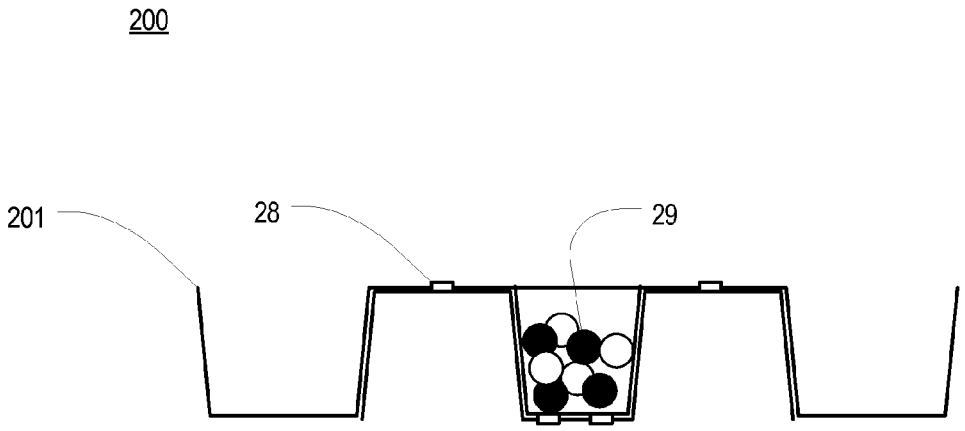
FIG. 10A is a side cross-sectional view of the collapsible target structure of FIG. 7, shown in a collapsed storage and travel state.
Figure 10B:
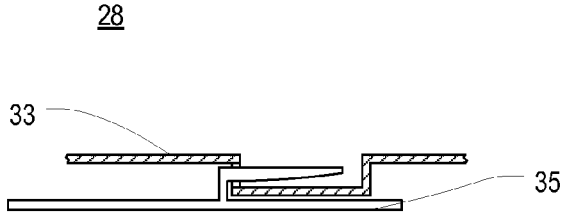
FIG. 10B is a cut section detail of the finger lock and box slot connection for secure structure during storage and transport.

FIG. 10A is a side cross-sectional view of the collapsible target structure 201 of FIG. 7, shown in a collapsed travel state. As shown therein, the middle bucket 23 may be removed from the top and bottom buckets 22,24 and rotated upside down 180 degrees, so that the smallest bucket 24 sits in the concaved area of the underside of the middle bucket 23, and the middle bucket 23 is twisted to lock in place to the box slots 33 on underside of the largest bucket 22. FIG. 10B is a cut section detail of the finger lock 35 and box slot 33 connection 28 to achieve desired collapsed configuration for secure structure during storage and transport. As shown, projectile objects 29 may also be stored in the void of bucket 24 and underside of bucket 22.

In other embodiments, the buckets 22,23,24 may be assembled into the state shown in FIG. 7 by snapping the buckets together rather than twisting. The flared aspect of inner and outer bucket walls has been designed to allow for the nesting of buckets 23,24 inside the larger bucket 22 creating a collapsible multi-component structure. As described herein, the "finger lock" 35 and "box slot" 33 aspects allow for the upper two buckets 23,24 to twist and lock into place both during gameplay and storage configurations. It is understood that the "box slot" 33 and "finger lock" 35 details can be accomplished in a number of different design variations and this embodiment is just one of many examples of how bucket components can be locked and unlocked to achieve desired collapsible structure. This is in no way intended to limit the invention, its application, or desired uses. In at least some embodiments, the various buckets and their cylindrical walls (inner and outer) are concentric with each other. In at least some embodiments, the buckets are made of plastic, but in other embodiments the buckets are made of metal, a combination of plastic and metal, or the like.

Figure 11:
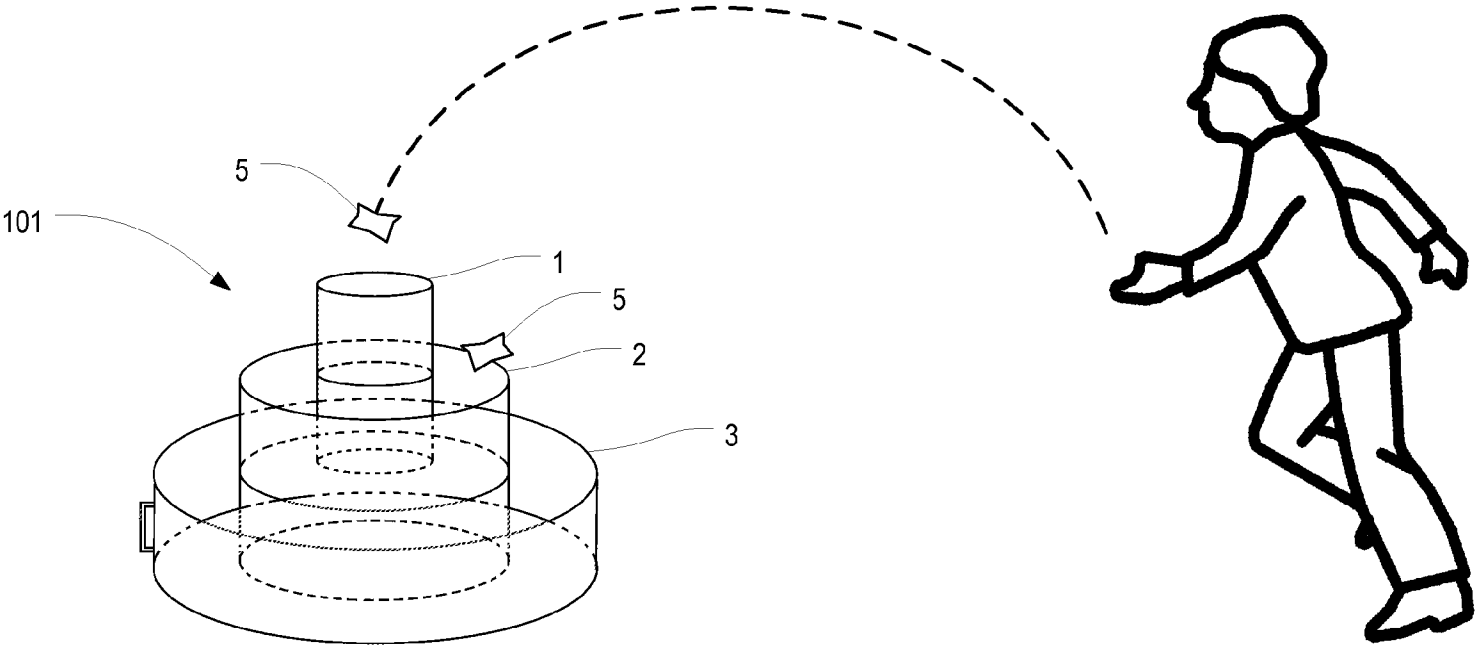
FIG. 11 is a perspective view of a player using the soft toss game apparatus of FIG. 1.

FIG. 11 is a perspective view of a player using the soft toss game apparatus 100 of FIG. 1. The apparatus 100 may be used to facilitate games and other activities in a variety of ways. In a "traditional"-style game, two or more teams of from 1 to 4 players on each team divide the beanbags 5 or other objects such that each team has an equal number of objects. For example, two teams of two players each could each have four beanbags (and could divide the four beanbags evenly among themselves). The objects are provided in at least two different color or decoration schemes so that the objects belonging to one team may be differentiated from those of the other team(s). The teams take turns tossing their objects at the collapsible target structure 101. Projectiles 5,6 can be tossed in a number of different predetermined or undetermined styles (overhead, underhand, backhand, sidearm, and etc.) according to type of gameplay desired. After a player throws his/her beanbag 5 at the target structure 101, they are awarded points according to which tiered bucket 1,2,3 they land in. For example, in method of game play, the lower bucket 1 is 1 point, the middle tiered bucket 2 is 2 points and the tall center bucket 3 is 3 points (missing the target is zero points). If beanbags 5 or certain other objects are used, they might land on the lip of a bucket and remain there, as shown in FIG. 11. When this happens, the team tossing the beanbag may be awarded only the points for the bucket tier below where it is hanging. Therefore, if a bag comes to rest on the lip of bucket 1, zero (0) points will be awarded. Teams (players) alternate turns throwing their bags at the target. The last beanbag or other object may be worth double the point value assigned to each bucket tier, and in at least some game versions may be called the Bulzi Bag. If this bag misses the target, points may be deducted from the team's score. The teams' (players') scores are totaled and the team (player) with the highest points will be awarded a score of the difference between his points in the opposing player's points. For example, if the higher scoring team scores 8 points and the lower scoring team scores 5 points, the higher scoring team would be awarded 8−5=3 points for that round (and the lower scoring team would be awarded zero points). The teams or players may continue playing until one team (player) reaches 21 points (or some other designated total), at which point the game is over and the higher-scoring team or player is declared the winner.

Figure 12:
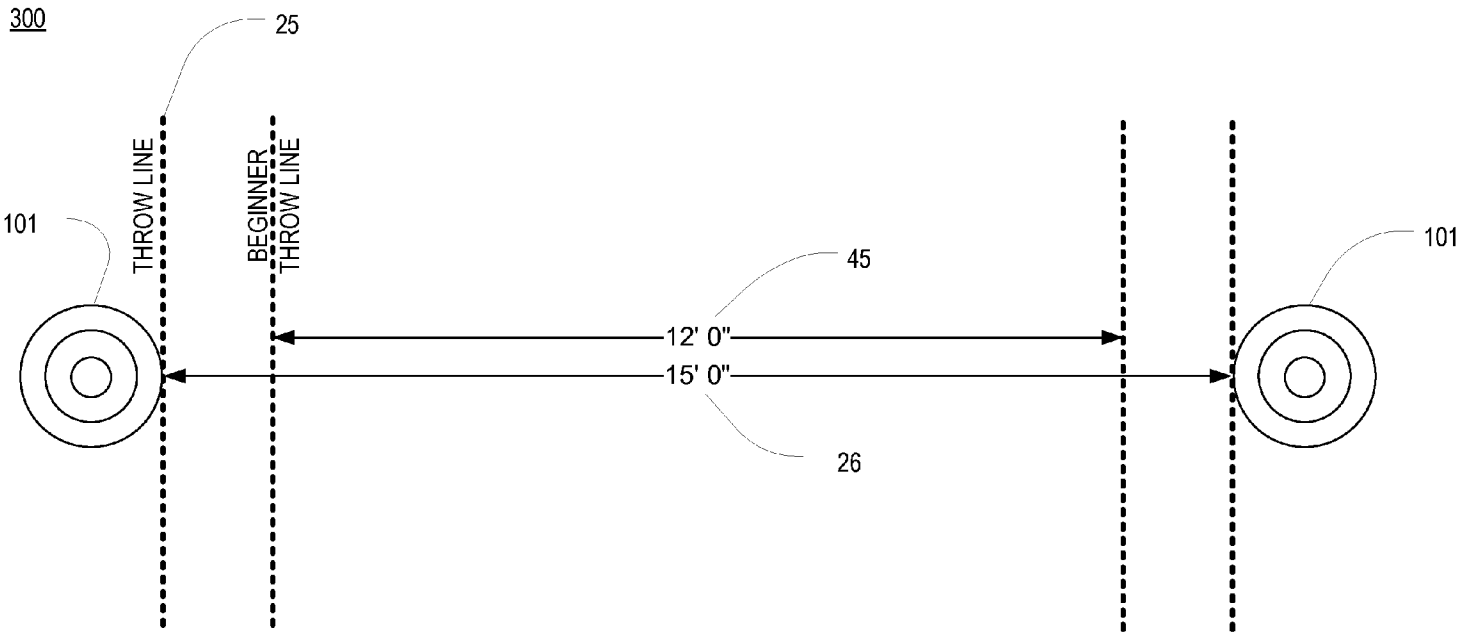
FIG. 12 is an aerial view of a potential gameplay setup using multiple soft toss game apparatus of FIG. 1 or FIG. 7, where team play of up to 4 individuals is involved.

FIG. 12 is an aerial perspective view of a multi target soft toss game apparatus setup 300 consisting of more than one collapsible target structure 101 of FIG. 1. Setup includes throw lines 25 and recommended target game separation for beginners 45 and advanced players 26. It is understood that can be accomplished the multi target soft toss game apparatus setup 300 can be accomplished with various embodiments of the collapsible target structure 101.

In a "BulziBucket"-style game, a game is played similarly to the traditional way, except that a team (player) must land a bag in the bottom bucket 1 (awarding 1 point) before they can be awarded points for making a bag in the middle tier bucket, and must make a bag in the middle bucket 2 (awarding 2 points) prior to being awarded points for making it into the tall center bucket 3 (awarding 3 points). The last (or 4th) bag each round may also be awarded double or negative points, similar to the traditional style of play. The maximum points per round would be 12. This game play is meant for the more for the experienced and skilled player.

It will be appreciated that a wide variety of alternative games may be played, with different point values, goals, or the like. Furthermore, games of "H-O-R-S-E" may be played, or individuals, players, or teams may merely challenge themselves or others to make shots from various distances, locations, or the like.

Based on the foregoing information, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements; the present invention being limited only by the claims appended hereto and the equivalents thereof.

What is claimed is:

1. A toss game apparatus for receiving a tossable object, comprising:

a first bucket;

a second bucket;

a third bucket;

wherein the first, second, and third buckets may alternately be placed in a deployed configuration and a nested configuration;

wherein the first bucket includes a first outer perimeter wall, wherein the second bucket includes a second outer perimeter wall, wherein the third bucket includes a third outer perimeter wall, and wherein a diameter of the first outer perimeter wall is wider than diameters of the second and third outer perimeter walls and the diameter of the second outer perimeter wall is wider than the diameter of the third outer perimeter wall;

wherein the first bucket further includes a first bottom wall, a first target area for receiving a tossable object, a first inner side wall, and a first interior platform, wherein the first outer perimeter wall provides a lateral boundary to the first target area, wherein the first bottom wall provides a lower boundary to the first target area, wherein the first target area includes an open top, wherein the first interior platform is supported above the first bottom wall by the first inner side wall;

wherein the second bucket further includes a second bottom wall, a second target area for receiving a tossable object, a second inner side wall, and a second interior platform, wherein the second outer perimeter wall provides a lateral boundary to the second target area, wherein the second bottom wall provides a lower boundary to the second target area, wherein the second target area includes an open top, and wherein the second interior platform is supported above the second bottom wall by the second inner side wall;

wherein the third bucket further includes a third target area for receiving a tossable object and a third bottom wall, wherein the third outer perimeter wall provides a lateral boundary to the third target area, wherein the third bottom wall provides a lower boundary to the third target area, and wherein the third target area includes an open top;

wherein the first bucket further includes a first bottom recess opposite the first interior platform, the first bottom recess being defined by the first interior platform and the first inner side wall and being sized to receive the second bucket in an inverted orientation;

wherein the second bucket further includes a second bottom recess opposite the second interior platform, the second bottom recess being defined by the second interior platform and the second inner side wall and being sized to receive the third bucket in an inverted orientation;

wherein the first outer perimeter wall is flared outward from a periphery of the first bottom wall;

wherein the second outer perimeter wall is flared outward from a periphery of the second bottom wall;

wherein the third outer perimeter wall is flared outward from a periphery of the third bottom wall;

wherein the first inner side wall includes a flare, the flare being the same as the flare of the second outer perimeter wall when one of the first or second buckets is inverted to facilitate nesting of the second bucket in the first bottom recess;

wherein the second inner side wall includes a flare, the flare being the same as the flare of the third outer perimeter wall when one of the second or third buckets is inverted to facilitate nesting of the third bucket in the second bottom recess;

wherein the first interior platform includes a first plurality of fastening elements;

wherein a bottom side of the second bottom wall includes a second plurality of fastening elements;

wherein, in the deployed configuration:

the first plurality of fastening elements are connected with the second plurality of fastening elements to join the second bucket on top of the first interior platform of the first bucket, a bottom of the third bottom wall is joined to the second interior platform of the second bucket, and the first, second, and third target areas are concentrically arranged; and wherein, in the nested configuration:

one of the first, second, and third buckets is inverted from its orientation in the deployed configuration, the third bucket is received in the second bottom recess, and the second bucket is received in the first bottom recess.

2. The apparatus of claim 1, wherein the first target area and the second target area each comprises a donut shape.

3. The apparatus of claim 2, wherein:

the first bottom wall comprises a first upper surface and a bottom side, the first upper surface faces the first target area, the bottom side is opposite the first upper surface, and the bottom side is configured to rest on an exterior surface to support the first bucket; and the second bottom wall comprises a second upper surface, the second upper surface faces the second target area, the bottom side of the second bottom wall is opposite the second upper surface, and the bottom side of the second bottom wall is configured to rest on the first interior platform.

4. The apparatus of claim 1, wherein:

the second plurality of fastening elements are disposed on the second bottom wall;

the second interior platform includes a third plurality of fastening elements;

the third bottom wall includes a fourth plurality of fastening elements;

when in the deployed configuration, the third plurality of fastening elements are connected with the fourth plurality of fastening elements to join the third bucket on top of the second interior platform of the second bucket; and each of the first, second, third, and fourth plurality of fastening elements comprises a finger lock or a slot for receiving a finger lock.

5. The apparatus of claim 1, wherein the first, second, and third outer perimeter walls each have a circular cross-section.

6. The apparatus of claim 1, wherein, when in the nested configuration, the first interior platform covers the third target area.

7. The apparatus of claim 1 wherein, when in the nested configuration, the second bucket is inverted from its orientation in the deployed configuration.

8. The apparatus of claim 1, wherein the first interior platform is centered within the first bucket, the first target area surrounds the first interior platform, the second interior platform is centered within the second bucket, and the second target area surrounds the second interior platform.

9. The apparatus of claim 8, wherein, when in the deployed configuration, the first target area is located below the first interior platform and the second target area is located below the second interior platform.

10. The apparatus of claim 1, wherein, when in the deployed configuration, the third bucket covers a top surface of the second interior platform and the second bucket covers a top surface of the first interior platform.

11. The apparatus of claim 1, wherein:

the first inner side wall is flared inward from the first bottom wall toward a center of the first bucket;

the second inner side wall is flared inward from the second bottom wall toward a center of the second bucket; and the first outer perimeter wall diverges from the first inner side wall, and the second outer perimeter wall diverges from the second inner side wall.

12. The apparatus of claim 1, wherein the second interior platform has a height that is the same as a height of the second outer perimeter wall.

13. The apparatus of claim 1, wherein the first bottom recess comprises a depth that is sufficient to receive an entire height of the second bucket, and the second bottom recess comprises a depth that is sufficient to receive an entire height of the third bucket.

14. The apparatus of claim 1, wherein a height of each of the first, second, and third buckets are equal.

15. The apparatus of claim 1, wherein:

the first bottom wall includes a first upper surface and a first bottom side, the first upper surface faces the first target area, the bottom side is opposite the first upper surface, and the bottom side is configured to rest on an exterior surface to support the first bucket;

the second bottom wall includes a second upper surface, the second upper surface faces the second target area, the bottom side of the second bottom wall is opposite the second upper surface, and the bottom side of the second bottom wall is configured to rest on the first interior platform;

the first, second, and third outer perimeter walls each have a circular cross-section;

when in the nested configuration, the first interior platform covers the third target area, and the first and third buckets are inverted from their respective deployed position;

the first interior platform is centered within the first bucket and the first target area surrounds the first interior platform; the second interior platform is centered within the second bucket and the second target area surrounds the second interior platform;

the first target area is located below the first interior platform, and the second target area is located below the second interior platform;

the first inner side wall is flared inward from the first bottom wall toward a center of the first bucket;

the second inner side wall is flared inward from the second bottom wall toward a center of the second bucket;

the first outer perimeter wall diverges from the first inner side wall, and the second outer perimeter wall diverges from the second inner side wall;

the second interior platform comprises a height that is the same as a height of the second outer perimeter wall; and, the first bottom recess comprises a depth that is sufficient to receive an entire height of the second bucket; the second bottom recess comprises a depth that is sufficient to receive an entire height of the third bucket.

16. The apparatus of claim 1, wherein the first interior platform has a height that is the same as a height of the first outer perimeter wall.

* * * * *